US008029244B2

(12) United States Patent
Dumas et al.

(10) Patent No.: US 8,029,244 B2
(45) Date of Patent: Oct. 4, 2011

(54) FLUID FLOW AMPLIFIER

(76) Inventors: Elijah Dumas, San Jose, CA (US); Elisha Dumas, San Jose, CA (US); Howard Dumas, San Jose, CA (US)

( * ) Notice: Subject to any disclaimer, the term of this patent is extended or adjusted under 35 U.S.C. 154(b) by 1096 days.

(21) Appl. No.: 11/888,379

(22) Filed: Aug. 2, 2007

(65) Prior Publication Data

US 2009/0032130 A1 Feb. 5, 2009

(51) Int. Cl.
*F04F 5/00* (2006.01)

(52) U.S. Cl. ..... 417/176; 417/187; 417/197; 239/590.5; 239/597

(58) Field of Classification Search ..... 417/175, 417/176, 187, 197; 239/590.5, 597
See application file for complete search history.

(56) References Cited

U.S. PATENT DOCUMENTS 4,046,492 A 9/1977 Inglis
4,838,618 A * 6/1989 Blackmon, Jr. ..... 303/66
5,064,423 A 11/1991 Lorenz et al.
5,074,759 A * 12/1991 Cossairt ..... 417/198
5,402,938 A * 4/1995 Sweeney ..... 239/431
5,411,142 A * 5/1995 Abbott et al. ..... 209/29
5,638,796 A 6/1997 Adams, III et al.
5,951,006 A * 9/1999 Biegelsen et al. ..... 271/195
6,243,966 B1 6/2001 Lubomirsky et al.
6,444,345 B2 * 9/2002 Sang ..... 429/415
6,568,203 B1 * 5/2003 Leathers ..... 62/402
6,826,910 B1 * 12/2004 Easton ..... 60/597
7,028,677 B2 4/2006 Martin
7,043,913 B2 5/2006 Nishiyama et al.

* cited by examiner

*Primary Examiner* — Charles Freay
*Assistant Examiner* — Patrick Hamo

(57) ABSTRACT

A by-pass fluid flow amplifier which contains a primary nozzle and a primary profile for discharging compressed air into a conduit of the air amplifier and entraining ambient air in the process. A secondary nozzle and a secondary profile for discharging compressed air into the conduit of the air amplifier towards the rear that assists the primary nozzle such as to allow consistent fluid wall attachment of the compressed air and the entrained air caused by the primary nozzle and the primary profile. The secondary nozzle increases the total flow of the amplifier and prohibits the total flow from traveling towards the center of the conduit where flow reversal and turbulence are likely to occur.

9 Claims, 3 Drawing Sheets

PRIOR ART

FLUID FLOW AMPLIFIER

FIELD OF INVENTION

This invention relates to the field of fluid flow amplifiers and in particular to fluid flow amplifiers that can operate at high inlet pressures ranging from 125 psig to 1000 psig+ (8.77 kg/cm$^2$ to 70 kg/cm$^2$) while having maximum air entrainment efficiency, maximum outlet velocity, and resistance to flow reversal and turbulence.

BACKGROUND OF INVENTION—PRIOR ART

Fluid flow amplifiers, which are also called thrust jets or air flow amplifiers when the fluid is air, are pressure velocity transducers that use a small amount of a compressed fluid, e.g., compressed air, as their power source. Normally, such a device consists of two pieces. The first piece is called a body and the second piece is called a plug. The plug typically has a seal ring to seal pressurized air from leaking. The plug is screwed into the body thus forming an annular chamber and a nozzle between the body and the plug. The body has an inlet to which compressed air is introduced. As compressed air flows through the inlet, it fills the annular chamber and is then discharged through the nozzle. As the compressed air leaves the nozzle, its pressure is changed for increase in velocity. The high velocity air "adheres" to a profile, e.g., a Coanda profile of the plug, and entrains ambient air from an inlet formed by the body thus forming an air flow of high volume and speed.

Such fluid flow amplifiers are used for venting weld smoke, cooling hot parts, drying wet parts, cleaning machined parts, distributing heat in molds or ovens, or moving debris. In pending U.S. patent application Ser. No. 11/510,468 filed by the same applicants it was shown that such pressure velocity transducers can be used for driving turbomachinery to supersonic speeds. Driving turbomachinery to supersonic speeds with an air amplifier became possible because the turbomachine, which comprises mainly a compressor and a turbine, can be made of thermoplastics instead of heavy metals thus reducing inertia start-up load by a significant factor as compared to current-art turbomachinery.

Another fact that was shown concerning air-amplifier-powered turbomachinery was that, unlike an exhaust powered turbomachine, e.g., a turbocharger which gets hotter the faster it spins, an air-amplifier-powered turbocharger gets colder the faster it spins due to adiabatic cooling of compressed air.

The combination of low inertia start-up load and a cold-driven turbine cancels any excess heat of air compression. In other words, the turbine temperature is kept at or below ambient temperature such that temperature differential is kept at a minimum while still achieving high tip speeds needed for air compression. The turbine has no heat radiation. The only heat transfer occurs in the change of angular momentum of the rotating components. The aforementioned advantages allow for compressing air at a dramatically low discharge temperature as compared to current-art turbomachinery.

In a simplified form, the existing arrangements of an air amplifier that is used for venting weld smoke, cooling hot parts, drying wet parts, cleaning machined parts, distributing heat in molds or ovens, moving debris or driving turbomachinery to supersonic speeds can be illustrated by the arrangement shown in FIG. 1 below.

FIG. 1 is a simple view illustrating a known arrangement of an air flow amplifier with a ninety-degree angle discharge nozzle followed by a Coanda profile.

The arrangement shown in FIG. 1 consists of an air amplifier 10 having a body 12 and a plug 14 screwed into the rear end of the body 12 by means of a thread 13, and a lock ring 16 that is used to fasten the body 12 to the plug 14. The mating surfaces are sealed by means of an O-ring 22. At the front end of the air amplifier the body 12 and the plug 14 form an annular chamber 18 and a ninety-degree-angle nozzle 20. The body 12 has a tapered inlet 24 for access to ambient air and a transversely arranged fluid inlet 26 for the supply of a primary-flow fluid "f". The central opening of the plug 14 forms an exhaust outlet 28, and the front end face of the plug has an air-entrapping profile 30 e.g., a Coanda profile for entraining ambient air. The Coanda effect, also known as "boundary layer attachment", is the tendency of a stream of fluid to stay attached to a convex surface, rather than follow a straight line in its original direction. The principle was named after Romanian discoverer, who was the first to understand the practical importance of the phenomenon for aircraft development.

As a compressed fluid, e.g., compressed air (black arrows "f"), is introduced in the fluid inlet 26, it fills the annular chamber 18. The compressed fluid is then discharged through the nozzle 20 and adheres to the profile 30 which entrains the secondary fluid F, e.g., ambient air, through the inlet 24. As a result, a high-volume, high-velocity air flow AF is exhausted from the outlet 28.

Air amplifiers based on the principle described above are incorporated into different structural designs which are shown in the patents mentioned below for illustration purposes.

U.S. Pat. No. 6,243,966 issued in 2001 to Lubomirsky, et al presents an air amplifier device which has a body with two pieces which fit together and have an inner wall defining a generally cylindrical cavity with a center axis and with an entrance opening at its upper end and an exit opening at its other end. The two pieces have respective shoulders which abut to index the pieces in precise relationship radially, axially, and longitudinally. A pair of circular lips in the inner wall near the entrance opening form a venturi jet air opening through the inner wall to direct a controlled flow of air from a supply of air down into the cylindrical cavity. The lips are uniformly parallel with each other and concentric with the center axis, are closely and uniformly spaced apart for 360 degrees around their lengths and are two circular edges of the respective pieces, and are indexed to the respective shoulders of the pieces such that when the pieces are assembled the jet air opening is uniform within a fraction of a thousandth of an inch.

U.S. Pat. No. 5,402,398 issued in 1995 to Sweeney presents an air amplifier which is provided for use in pneumatic control systems that can operate over a wide range of flow and pressure characteristics, and can additionally operate against a back pressure. The air amplifier utilizes a tapered shim that causes the pressurized air to follow a Coanda profile over a wider range (and against a back pressure) than is possible when using only a slotted, non-tapered shim. The shim is ring-shaped with a planar surface and includes inwardly directed tangs that are cut-off to provide an open central area. Some or all of the tangs are tapered along either one or both sides of the tang.

U.S. Pat. No. 4,046,492 issued in 1977 to Inglis presents an air flow amplifier of relatively high air flow amplification ratios in which a thin film of pressurized primary air flowing in a transverse direction is mechanically deflected to impinge on a generally frusto-conical surface tapering towards the throat of the amplifier. The deflecting action is produced by a deflection ring which is spaced inwardly from the amplifier's annular nozzle. The ring has an internal diameter substantially larger than the amplifier's throat so that secondary air entering through the ring may flow directly towards the frusto-conical surface to mix with the primary air flowing along that surface.

Air amplifiers are designed to operate at normal shop air pressures ranging from 6.8 atm to 8.5 atm (100 psig-125 psig). Although there are some off the shelf air amplifier products that state operation of 17 atm (250 psig max), these air amplifiers cannot be operated at such pressures without extremely low gap settings ranging from 0.05 to 0.10 mm (0.002-0.004 inches). Such low gap settings results in a mediocre-performing air amplifier suitable for driving a low inertia turbocharger, for moving fumes, etc.

When operating at a gap setting of 0.23 mm (0.009 inches), the air amplifier can perform at high air consumption rates, high velocities, and maximum air entrainment. However, when pressures increase beyond 8.5 atm (125 psig), this causes flow reversal and turbulence thus resulting in a significant loss and waste of energy.

Flow reversal and turbulence occurs because at low pressures the compressed air can adhere to the designed profile, e.g., Coanda profile.

As inlet pressure to the air amplifier is increased, the velocity of the compressed air through the nozzle is increased as well, so instead of the high velocity fluid following the profile, it flows towards the center. Once the high velocity fluid reaches the center, it crashes and tumbles which results in partial air entrainment and partial energy waste.

Since air amplifiers in general are not used for driving turbomachinery, heretofore there were no demand for designing an air amplifier that could operate at high pressures, e.g., 34 atm (500 psig) or higher and at the same time could be resistant to flow reversal and turbulence. Despite the current up-to-date design, at gap settings of 0.22 mm (0.009 inches) conventional air amplifiers develop flow reversal and turbulence already at pressures much lower than 34 atm (500 psig), i.e., at 8.5 atm (125 psig).

Inventors herein tried to use shims, unique air entrainment profiles, or a combination of both to achieve maximum air entrainment, air velocity, and air consumption but still could not eliminate flow reversal and turbulence resistance when pressure exceeded 8.5 atm (125 psig) and the gaps were set at 0.22 mm (0.009 inches). An air amplifier described in above U.S. Pat. No. 5,402,398 issued in 1995 to Sweeney could overcome the above problem but only to a limited extent.

Thus, a common disadvantage of all known air amplifier devices of the aforementioned type is that they are unsuitable for use in driving turbomachinery and, if tried for such applications, are prone to flow reversal and turbulence which limit their ability to drive a turbomachine to high tip speeds.

For example, for experimental purposes the inventors herein developed a low inertia turbocharger using dual ceramic ball bearings and two Garrett T3 50 trim compressor impellers. One impeller served as a turbine because of its low weight as compared to the stock turbine, while the other compressor was used to compress air.

Two T3 0.42 air compressor housings were also used. One served to allow air compression of one of the impellers while the other housing was used as a turbine housing for the other impeller. An adjustable air amplifier model 6031 produced by Exair was used, and it was powered by a 120 cf scuba tank pressurized to 184 atm (2700 psig). The pressure was regulated down to 8.5 atm (125 psig). The gap setting on the air amplifier was set to 0.22 mm (0.009 inches). By using a flow valve, air from the scuba tank flowed through the pressure regulator to a centrifugal water separator, and then finally to the air amplifier.

A steady state tip speed of 30,000 rpm was reached, to which the impeller supplied about 50 cfm at a low pressure ratio, while the air amplifier consumed about 50-85 cfm at 8.5 atm (125 psig). Although 30,000 rpm was reached, the flow valve had to be turned on very slowly which wasted energy. Quickly turning on the flow valve resulted in uncontrollable flow reversal and turbulence which never ceased to stop or straighten out, and this decreased tip speed down to 18,000 rpm. Pressure was then increased from 8.5 atm (125 psig) psig to 17 atm (250 psig), which is the maximum rated pressure of the air amplifier. The flow valve was opened and a drastic amount of energy was lost through flow reversal and turbulence. In this case, the tip speed of 20,000 rpm was reached.

If the air amplifier could have operated without flow reversal or turbulence, tip speeds of 50000-60000 rpm could have been obtained at 17 atm (250 psig). Higher tip speeds into the 100000 rpm region at 17 atm (250 psig) could also be obtained if the impellers were made of thermoplastics, a turbine were used instead of a compressor, air bearings were used instead of a ceramic bearings, a turbine housing were used instead of a compressor housing, the compressor weres faced toward the turbine, the air amplifier were positioned closer to the turbine, and the wheels were positioned as close as possible to their designated housing. In other words, air amplifiers of known designs make it possible to reach the maximum speed of 153,500 rpm at high inlet pressures, but this can be achieve only at the expense of complicated and specific improvements that require a lot of experiments and adjustments.

After the tests stated above, the patented shim mentioned in U.S. Pat. No. 5,402,398 issued in 1995 to Sweeney was used to see if higher tip speeds would be obtained at pressures of 8.5 atm (125 psig) and 17 atm (250 psig). However, the use of the recommended shim did not produce a desired increase in speed. Instead, there was a significant drop in tip speed and air consumption. The shim stopped flow reversal and turbulence, but it choked potential air consumption, which decreased the overall kinetic energy of the air amplifier.

OBJECTS AND SUMMARY

Accordingly, it is an object of the invention to provide a fluid flow amplifier which can be operated at high inlet pressures ranging from 8.5 atm (125 psig) to 68 atm (1000 psig) while having maximum air entrainment efficiency, maximum outlet velocity, and resistance to flow reversal and turbulence.

It is another object to provide a fluid flow amplifier that can consume the entire output of a large air compressor and convert its compressed air into high-volume, high-velocity energy level needed for obtaining supersonic speeds with a turbomachine.

It is a further object to provide a fluid flow amplifier that has a reduced or completely eliminated reverse flow.

It is another object to provide a fluid flow amplifier suitable for driving turbomachinery to supersonic speeds.

It is a further object to provide a fluid flow amplifier of the aforementioned type which is provided with means for adjusting the flow amplifier to optimal operation conditions at high inlet pressures and maximum air entrainment efficiency.

The fluid amplifier of the invention has a self-contained source of a pressurized fluid, e.g., a large gas compressor, or a container with a compressed gas, e.g., compressed air, that is used as a primary pressurized fluid supplied to an annular chamber and to a nozzles of a fluid flow amplifier. The first portion of the pressurized airflow follows a 45° angle path which leads to a Coanda profile and proceeds in a desired flow direction in a conduit, while the second portion of the primary pressurized airflow leads to multiple-hollow chambers of the annular chamber, which further leads to an auxiliary by-pass passage that functions as an L-shaped primary nozzle typically found in air jets. The first portion of the primary pressurized airflow generates a low-pressure area at the center of the conduit that entrains a high volume of a secondary fluid, e.g., air from the ambient atmosphere, and thus draws this air into the conduit at high velocity.

The second portion of the primary pressurized airflow generates a secondary low pressure area at the rear of the conduit that entrains the first portion of the entrained air. As a result, the auxiliary L-shaped nozzle creates a strong vacuum that assists in dragging the pressurized primary air flow further into the air amplifier channel. As a result, the fluid flow amplifier can operate at high inlet pressures without flow reversal and turbulence.

According to another embodiment of the invention, the fluid flow amplifier is provided with means for adjusting the aforementioned by-pass channel and thus for finding conditions most optimal for balance between the inlet pressures and fluid entrainment efficiency.

DETAILED DESCRIPTION—PREFERRED EMBODIMENTS

The inventors herein have developed a fluid flow amplifier that will have the ability to operate at pressures ranging from 8.5 atm (125 psig) to 68 atm (1000+ psig) without flow reversal and turbulence, as what commonly happens in current-art air amplifiers. The use of a by-pass or secondary nozzle assists the primary nozzle such that pressurized airflow discharged from the primary nozzle is forced to flow to the rear of the air amplifier as smoothly as possible. The benefit a secondary nozzle is that it allows for obtaining high energy air flows needed for a turbomachine to acquire supersonic tip speeds.

Figure 1:
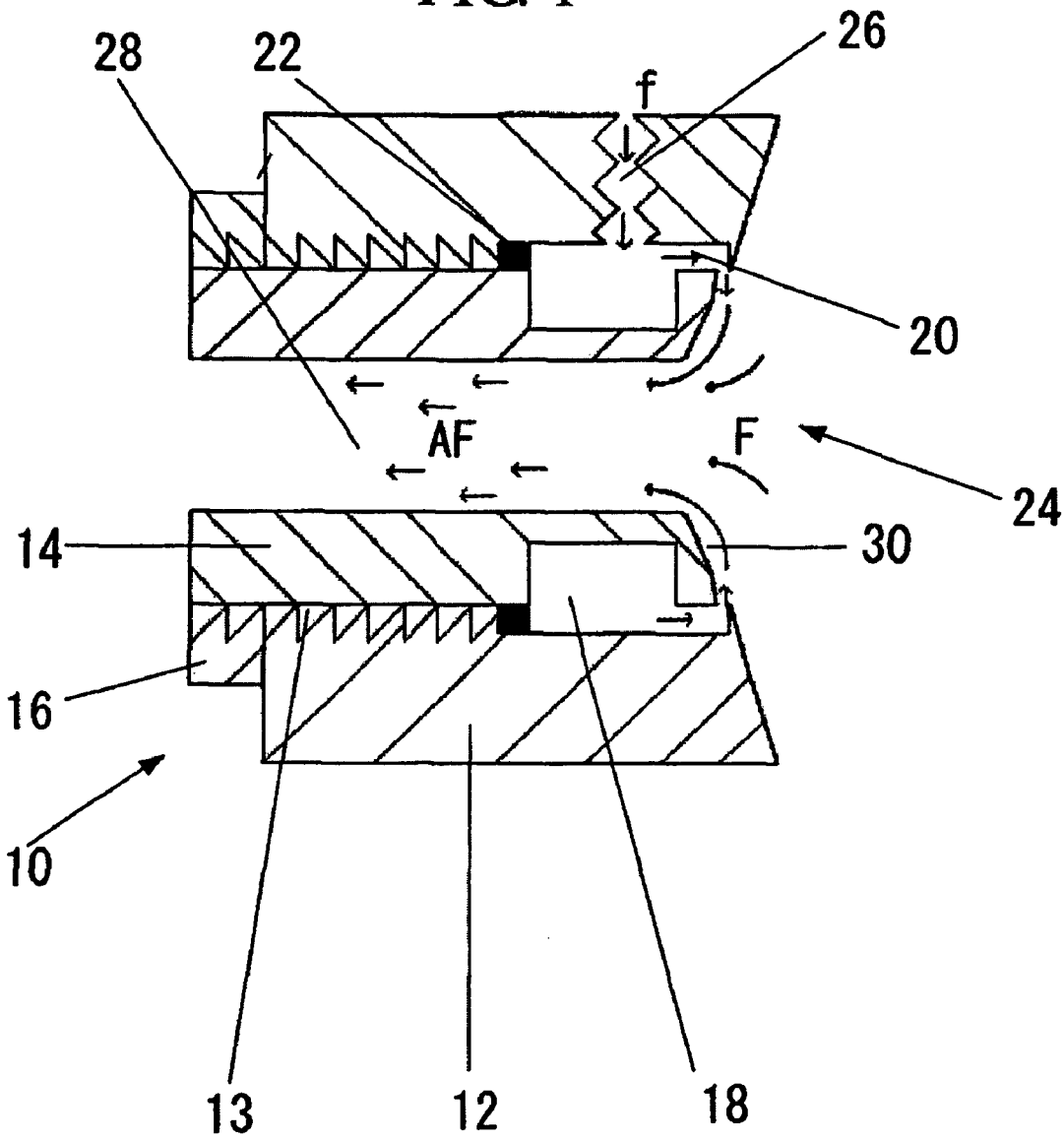
FIG. 1 is a view illustrating a known arrangement consisting of an air flow amplifier with a ninety-degree angle discharge nozzle followed by a Coanda profile.
Figure 2:
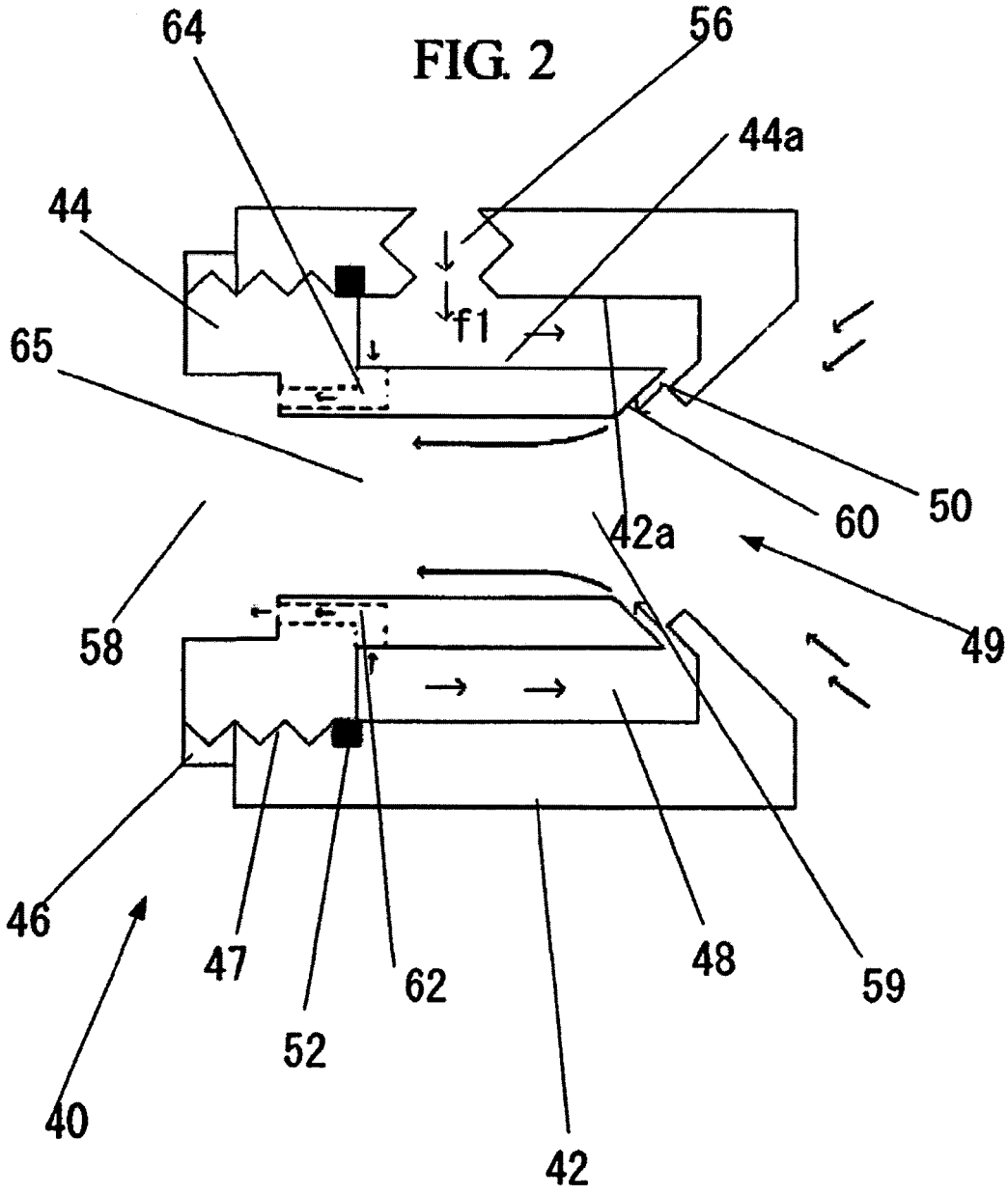
FIG. 2 is a view of an arrangement of the present invention that illustrates a by-pass nozzle fluid flow amplifier.

FIG. 2 is a view of an arrangement according to one embodiment of the present invention that illustrates a fluid flow amplifier with a by-pass or secondary nozzle. The arrangement shown in FIG. 2 consists essentially of an air amplifier 40 having a body 42, and a plug 44 connected to an amplifier body 42, e.g., by means of a threaded connection 47, and a lock ring 46 used to lock the threaded connection 47 against untwisting. The fluid flow amplifier body 42 has an inlet opening 49 at one end for a secondary fluid, e.g., ambient air, and a primary-fluid inlet 56 formed in the side wall of the body 42. As shown in FIG. 2, the inlet opening 49 is tapered with increase in the outward direction. The aforementioned plug 44 is connected to the body 42 from the side opposite to the inlet opening 49. The air amplifier has a central through opening 65 for a secondary flow, i.e., the flow of a fluid dragged into the fluid amplifier, that passes from the inlet opening 49 to an outlet end 58 of the air amplifier.

At least one annular closed inner cavity 48 is formed between the outer surface 44*a* of the plug 44 and the inner surface 42*a* of the body 42. This inner cavity 48 is connected to the aforementioned central through opening 64. The inlet end 59 of the central through opening 49 forms with the inlet opening 49 of the air amplifier 40 a primary nozzle 50 having a direction of flow at 30 to 60°, e.g., 45° to the direction of the main central passage 65.

An O-ring 52 is used to seal the mating surfaces, i.e., the amplifier body 42 and the plug 44. The plug 44 contains the aforementioned outlet end 58 and a profile 60, e.g., a Coanda profile for entraining ambient air F (FIG. 2), formed on the end of the plug opposite to the outlet end 58.

A distinguishing feature of the air amplifier 40 of the invention is a flow turbulence and reversing prevention means in the form of a secondary nozzle made as an L-shaped channel formed at the at the rear part of the air amplifier 40 between the annular chamber 48 and the main central passage 65 of the air amplifier. In the embodiment of FIG. 2, the aforementioned flow turbulence and reversing prevention means is shown in the form of two L-shaped secondary nozzles 62 and 64 that create secondary flows of the primary fluid for entrapment of the primary fluid from the central through channel 65.

The air amplifier 40 operates as follows:

As a primary fluid, i.e., compressed fluid, e.g., compressed air (black arrows "f1"), is introduced in the primary-fluid fluid inlet 56, it fills the annular chamber 48. Some of the compressed fluid is discharged through the primary nozzle 50 at 45° and adheres to the profile 60 e.g., the Coanda profile, which entrains the secondary fluid, e.g., ambient air, from the atmosphere into the inlet opening 49.

The L-shaped channels 62 and 64 receive the remaining amount of the compressed fluid from the annular chamber 48 and discharge it through the L-shaped secondary nozzles 62 and 64 towards the outlet 58 at a zero degree angle which entrains ambient air from the profile 60, which forces consistent fluid wall attachment. Once the compressed fluid emerging from the nozzle 50 and the entrained ambient air passes the profile 60, the nozzle 62 and 64 force the air flow at the zero degree angle towards the outlet 58 but not towards the center where flow reversal and turbulence are likely to occur.

Due to the compressed fluid emerging from the nozzles 62 and 64, extra ambient air F (FIG. 2) is pulled through the air amplifier 40 resulting in a more powerful device while keeping the device small. The gap setting of the nozzles 62 and 64 in this case can be in the range of 0.05 to 2 mm. The gap setting of the nozzle 50 is adjustable by tightening or loosing the plug 44 and locking the plug 44 to the body 42 with the lock ring 46.

Figure 3:
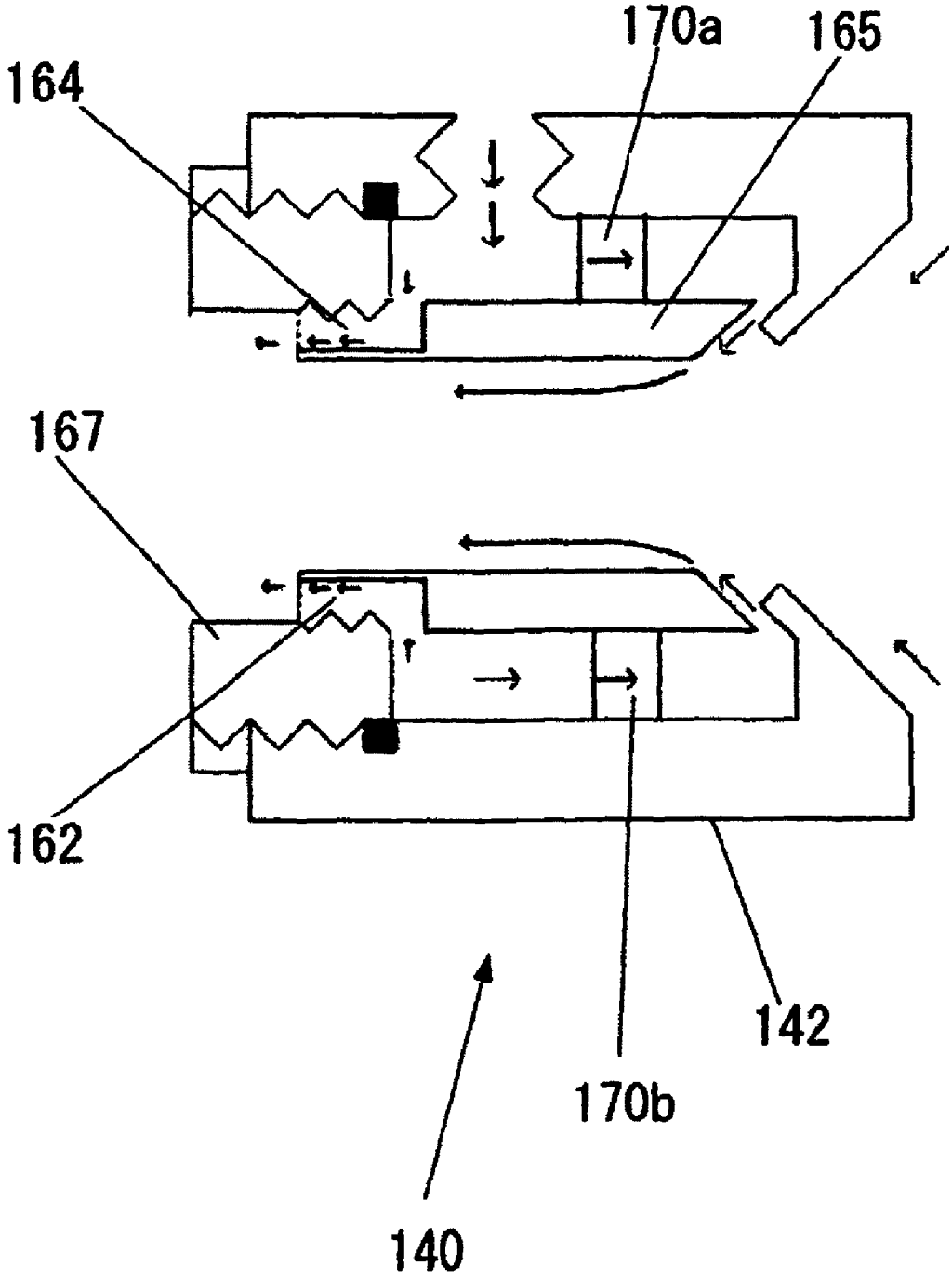
FIG. 3 is a view of FIG. 2 but with an adjustable gap plug for optimizing a fluid flow.

In the embodiment of FIG. 2, the gaps 62 and 64 are not adjustable since the L-shaped secondary nozzles are formed directly inside the body of the plug 44. In the embodiment of FIG. 3, which is a cross-section of an air amplifier 140 with the adjustable secondary nozzles 164 and 162, cross-sections of the nozzles 162 and 164 are adjustable. This is achieved by separating the front part 165 of the plug from the adjustable rear part 167 so that the secondary nozzles are formed between both parts 165 and 167 with possibility of adjusting the flow passing cross-sections of the nozzles 164 and 162 by threading the rear part of the plug 167 relative to the front part 165. In this case, the front part 165 is rigidly attached to the air amplifier body 142 by radial ribs 170*a* and 170*b*. The rest of the structure is similar to one shown in FIG. 2 and therefore description thereof is omitted.

Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For example, the nozzles and profiles can be of any angled configuration and of any amount. The objective behind a by-pass fluid flow amplifier is to pack more power in a smaller unit rather than building a larger unit. It is also the objective of a by-pass fluid flow amplifier to force the entrained air and the compressed air towards the rear of the air amplifier and not towards the center where a crash of the total flow is likely to occur, which will result in flow reversal and turbulence. Dimensions of the nozzles 162 and 164 can be adjusted by means other than the threaded connection. The device may have different number of L-shaped secondary nozzles, and secondary fluid is not necessarily air and may comprise any other gas.

The invention claimed is:

1. A fluid flow amplifier comprising:

a fluid flow amplifier body having an inlet opening at one end, said one end being tapered with increase of said inlet opening in the outward direction;

a plug inserted into and connected to the fluid flow amplifier body from the side opposite to the aforementioned inlet opening, said plug having a central through opening for a secondary fluid flow of the fluid flow amplifier, the central through opening having an inlet end located in proximity to the aforementioned inlet opening of the fluid flow amplifier body and an outlet end, said fluid flow amplifier body having an inner surface, and said plug having an outer surface, the inlet end of the central through opening forming with said inlet opening of the fluid flow amplifier body a primary nozzle, said primary nozzle having a profile that creates a near-wall flow effect for a flow of a secondary fluid that enters said inlet opening of the fluid flow amplifier body;

at least one closed inner cavity formed between the aforementioned inner surface of the fluid flow amplifier body and the outer surface of the plug, said closed inner cavity being connected to the aforementioned central through opening via said primary nozzle;

a channel for the supply of a primary fluid under pressure to the aforementioned inner cavity; and flow turbulence and reversing prevention means that connect the closed inner cavity with said central through opening near the aforementioned outlet end thereof, wherein the flow turbulence and reversing prevention means is at least one secondary nozzle that has a fluid passing diameter and is located near the outlet of the central through opening and creates a secondary flow of the primary fluid in the direction of the secondary flow for accelerating the aforementioned secondary flow, and wherein the flow turbulence and reversing prevention means have means for adjusting the aforementioned fluid passing diameter of the secondary nozzle.

2. The fluid flow amplifier of claim 1, wherein the fluid is air, and the aforementioned profile that creates a near-wall flow effect for a flow of a secondary fluid is a Coanda profile.

3. The fluid flow amplifier of claim 2, wherein said fluid flow amplifier can operate at inlet pressure of the primary fluid ranging from 125 psig to 1000 psig.

4. The fluid flow amplifier of claim 3, wherein the primary nozzle has a fluid passing diameter ranging from 0.05 to 2 mm.

5. The fluid flow amplifier of claim 1, wherein said one end which is tapered with increase of said inlet opening in the outward direction is tapered at an angle of 30 to 60°.

6. The fluid flow amplifier of claim 1, wherein the plug consists of a front part that is rigidly connected to said fluid flow amplifier body and a rear part that is connected to said fluid flow amplifier body by means of a thread so that said at least one secondary nozzle is formed between the rear part and the front part, and wherein said means for adjusting the aforementioned fluid passing diameter of the secondary nozzle is formed by the front part of the plug and the rear part of the plug that can be moved relative to said front part plug and rear parts of the plug by means of said a threaded connection for adjusting said at least one secondary nozzle.

7. A fluid flow amplifier comprising:

a fluid flow amplifier body having an inlet opening at one end, said one end being tapered with increase of said inlet opening in the outward direction;

a plug inserted into and connected to the fluid flow amplifier body from the side opposite to the aforementioned inlet opening, said plug having a central through opening for a secondary fluid flow of the fluid flow amplifier, the central through opening having an inlet end located in proximity to the aforementioned inlet opening of the fluid flow amplifier body and an outlet end, said fluid flow amplifier body having an inner surface, and said plug having an outer surface, the inlet end of the central through opening forming with said inlet opening of the fluid flow amplifier body a primary nozzle, said primary nozzle having a profile that creates a near-wall flow effect for a flow of a secondary fluid that enters said inlet opening of the fluid flow amplifier body;

at least one closed inner cavity formed between the aforementioned inner surface of the fluid flow amplifier body and the outer surface of the plug, said closed inner cavity being connected to the aforementioned central through opening via said primary nozzle;

a channel for the supply of a primary fluid under pressure to the aforementioned inner cavity; and flow turbulence and reversing prevention means that connect the closed inner cavity with said central through opening near the aforementioned outlet end thereof, wherein said one end which is tapered with increase of said inlet opening in the outward direction is tapered at an angle of 30 to 60°, the fluid is air, and the aforementioned profile that creates a near-wall flow effect for a flow of a secondary fluid is a Coanda profile, and wherein the flow turbulence and reversing prevention means have means for adjusting the aforementioned fluid passing diameter of the secondary nozzle.

8. The fluid flow amplifier of claim 7, wherein the primary nozzle has fluid passing diameter ranging from 0.05 to 2 mm.

9. The fluid flow amplifier of claim 7, wherein the plug consists of a front part that is rigidly connected to said fluid flow amplifier body and a rear part that is connected to said fluid flow amplifier body by means of a thread so that said at least one secondary nozzle is formed between the rear part and the front part, and wherein said means for adjusting the aforementioned fluid passing diameter of the secondary nozzle is formed by the front part of the plug and the rear part of the plug that can be moved relative to said front part plug and rear parts of the plug by means of said a threaded connection for adjusting said at least one secondary nozzle.

* * * * *